United States Patent [19]

Hollinger

[11] 3,960,299

[45] June 1, 1976

[54] INDUSTRIAL STRAW DISPENSING CARTON

[75] Inventor: Paul Hollinger, Randallstown, Md.

[73] Assignee: Maryland Cup Corporation, Owings Mills, Md.

[22] Filed: June 12, 1975

[21] Appl. No.: 586,246

[52] U.S. Cl. ..... 222/559; 229/17 B; 229/17 SC; 93/36 DA; 221/266

[51] Int. Cl.[2] ..... B65D 47/00

[58] Field of Search ..... 221/311, 312 C, 277, 221/266, 268, 269; 222/559, 561, 529, 531; 229/75 C, 75, 17 B, 17 SC, 17 R; 93/36 DA

[56] References Cited

UNITED STATES PATENTS

| | | | |
|---|---|---|---|
| 1,951,274 | 3/1934 | Denman | 222/561 |
| 2,294,979 | 9/1942 | Goldberg | 229/17 B |
| 2,582,207 | 1/1952 | Shaw | 222/559 |
| 2,931,554 | 4/1960 | Matern | 229/17 R |

*Primary Examiner*—Robert B. Reeves
*Assistant Examiner*—H. Grant Skaggs
*Attorney, Agent, or Firm*—Birch, Stewart, Kolasch & Birch

[57] ABSTRACT

A transportable and disposable feed hopper for straws or other elongated objects which feeds such objects out of the hopper in a predetermined orientation and at a selectively adjustable rate of egress.

2 Claims, 4 Drawing Figures

INDUSTRIAL STRAW DISPENSING CARTON

This invention relates to dispensing cartons and more particularly, to dispensing cartons for drinking straws such that bulk straws may be dispensed in an oriented position at a rate compatible with associated industrial processing of said straws,

SUMMARY OF THE INVENTION

The invention comprises a carton containing a plurality of commonly oriented straws or the like and having a cover flap with a removable portion defining a maximum dispensing opening at one end of the carton. A slide member of positioned beneath the cover flap and movable by means of an extended tab portion at one end thereof to position the other end of said slide member over all or a selected portion of said dispensing opening, between the oriented straws in the carton and said defined opening, to thereby determine the size of said opening and the resulting rate of egress of the straws dispensed therethrough. Thus, the invention provides a transportable and disposable feed hopper for straws or other elongated objects which feeds such objects out of the hopper or reservoir in a predetermined orientation and at a selectively adjustable rate of egress. Thus, the present invention serves as a disposable magazine for use with industrial straw handling and orienting devices.

Object of the Invention

It is, therefore, an object of the present invention to provide a new and novel feed hopper in the form of a disposable protective package for dispensing straws or other elongated objects in bulk, in a predetermined orientation and at selectively variable flow rates.

This and other objects of the present invention will become more fully apparent with reference to the following description and drawings which relate to a preferred embodiment of the invention.

DETAILED DESCRIPTION OF THE DRAWINGS

Figure 1:
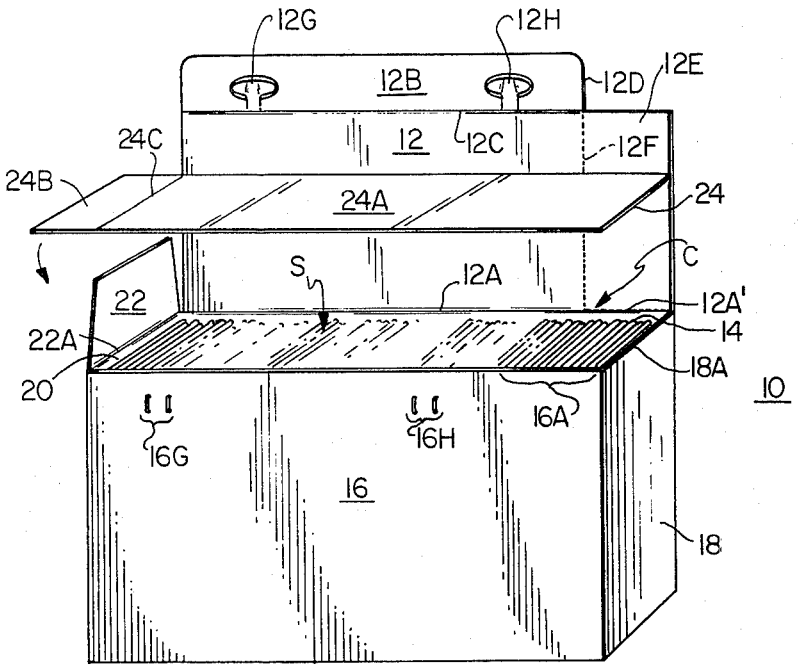
FIG. 1 is a perspective of the carton of the present invention in partially exploded view.

Referring in detail to the drawings and with particular reference to FIG. 1, the carton 10 of the present invention is shown as including an exterior closure flap 12 extending upward from and coterminately with a first side wall 14 along a folding or score line 12A, a second opposed side wall 16, a first end wall 18 and an opposed second end wall 20 having an interior closure flap 22 extending upward from and coterminate therewith along a folding or score line 22A; the said score lines being in a common plane and together with the uppermost edges of the said second side wall 16 and first end wall 18 defining an open cavity C in the carton 10. The box 10 is shown filled with straws S all oriented parallel to the first and second end walls 18 and 20.

The interior closure flap 22 is adapted to be folded inwardly along its score line 22A to overly the straws S when the carton 10 is in a closed condition. After the interior flap 22 is folded, a slide member 24 having a major portion 24A, dimensioned to be coextensive with the perimeter of the open cavity C, and an exterior retaining tab portion 24B joined at one end of the said major portion 24B at a score line 24C, is placed over the straws S and interior flap 22. The exterior retaining tab 24B is then folded downward on the score line 24C into juxtaposition with the exterior of the second end wall 20 to retain the slide member 24 in place. (The fully folded position of the retainer tab 24B is shown in dotted lines in FIG. 2).

Figure 2:
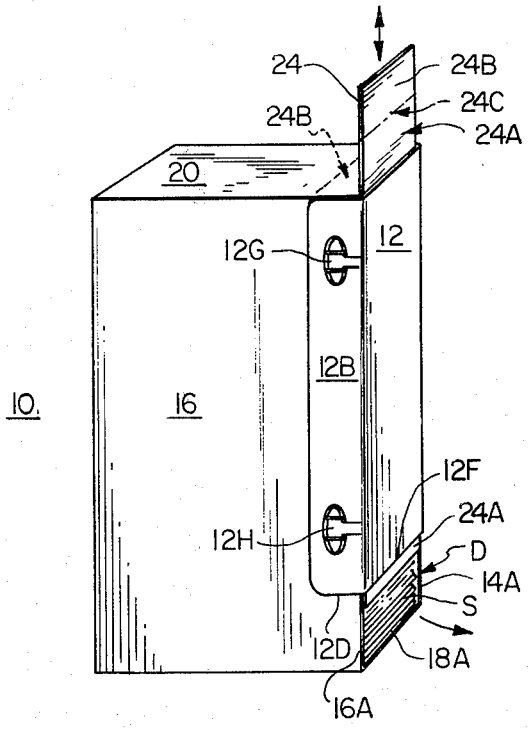
FIG. 2 is a perspective of the carton of the present invention positioned in the dispensing mode.

Referring jointly to FIGS. 1 and 2, the closure lid 12 of the carton 10 is folded inward on the score line 12A to overly the major portion 24A of the slide member 24 and thereby, together with the retainer tab 24B, hold the slide member 24 in position over the straws S. The outer edge of the lid 12 comprises a closure flap 12B with a defining score line 12C extending in closed position from the corner defined by the second sidewall 16 and the second end wall 20 along a substantial portion (as shown, a major portion) of the second sidewall 16 to a cut-back edge 12D in the provision of a removable dispensing flap 12E substantially coincident with the otherwise uncovered upper edge portion 16A and 18A of the second sidewall 16 and the first end wall 18. A line of perforations 12F, colinear with the cut-back edge 12D intersects with the main score line 12A of the lid 12 and that portion 12A' of the score line 12A from that intersection to the first end wall 18 is also a line of perforations. Thus, after closing the lid 12, the dispensing flap 12E is removable by tearing along the lines of perforations 12F and 12A'.

The lid 12 is provided with locking tabs 12G and 12H in the closure flap 12B which cooperate with lock slots 16G and 16H, respectively, in the second sidewall 16 to maintain the lid 12 in a secure and closed condition.

In operation, with the dispensing flap 12E removed, as shown in FIG. 2, and with the carton 10 standing on the first end wall 18, the retainer tab 24B of the slide member 24 is grasped, freed from any retaining glue or the like holding it to the second end wall 20 and then, is pulled upward such that the now lower edge of the major portion 24A is moved upward to define a dispensing opening D with the sidewall edges 14A and 16A and the first end wall edge 18A. Through this dispensing opening D, the straws or other elongated objects S will be dispensed in bulk and in common orientation under the influence of gravity and/or applied vibration at a predictable rate of flow depending upon the selected position of the slide member 24 which regulates the size of the dispensing opening D.

In the event that the carton 10 is used a feed hopper for an industrial process, such as in a straw wrapping and packaging machine, it can now be readily seen that a flow of straws or objects S can be established which is compatible with the production rate involved and that the entire bulk of straws or objects S will enter the machine in a known and predictable orientation. Thus, the need to refill feed hoppers with such articles as the straws S is eliminated, since the carton 10, when empty may be replaced by another as needed and the chance of improper orientation of each succeeding supply of article S is eliminated.

Figure 3:
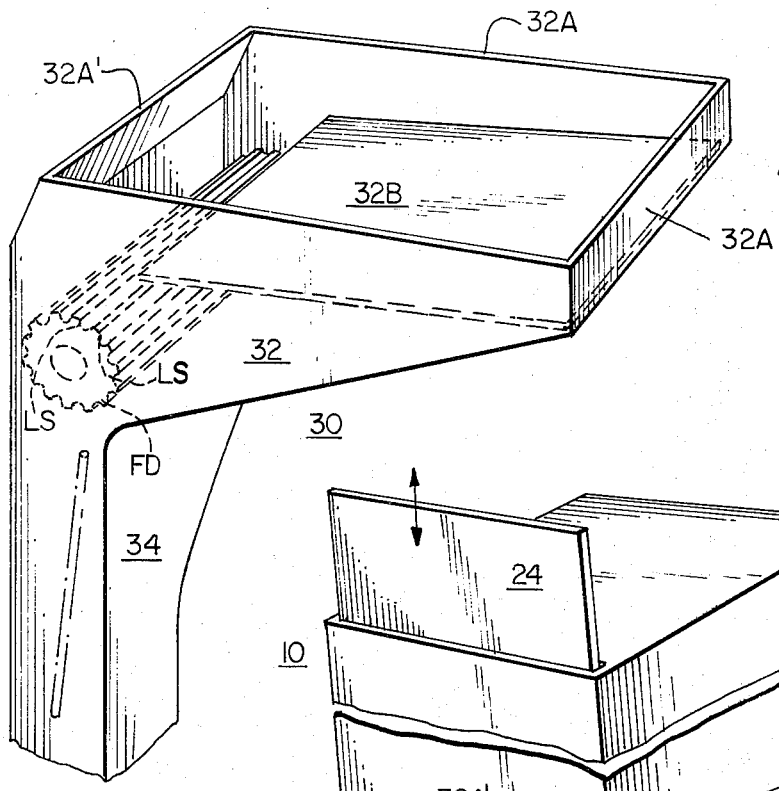
FIG. 3 is a perspective of a portion of an industrial straw feeding and orienting device of the general type to which the present invention is adopted for use.
Figure 4:
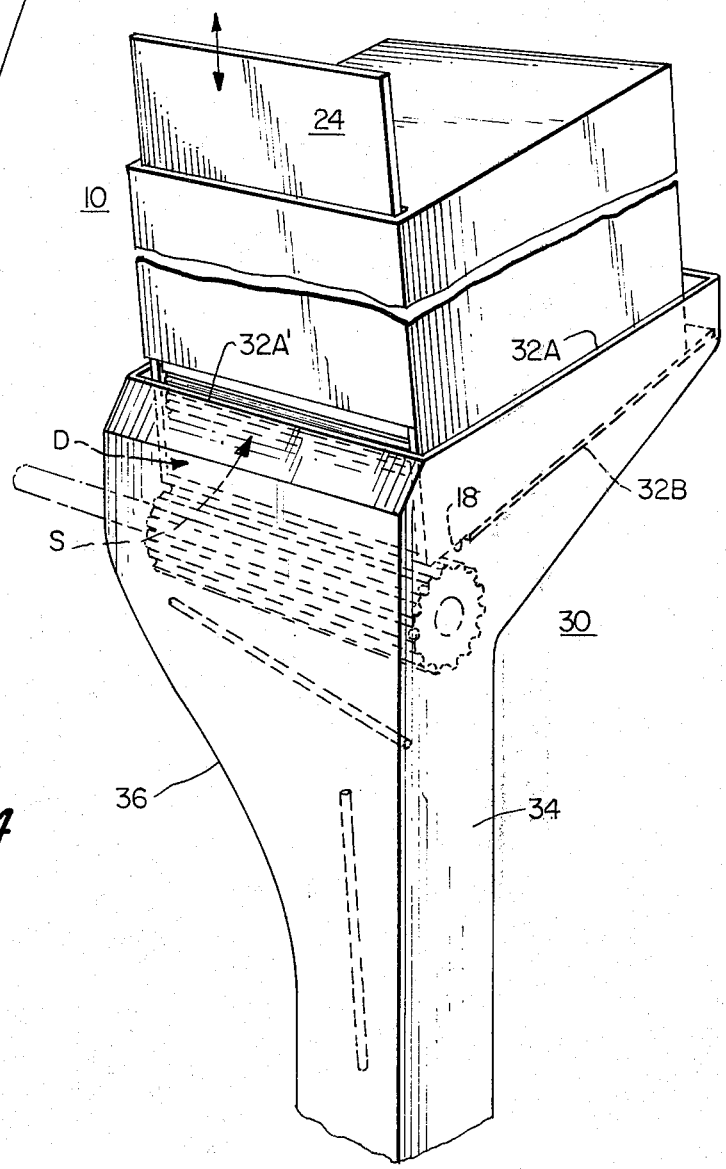
FIG. 4 is a perspective of the straw dispenser of the present invention mounted in the device shown in FIG. 3.

For example, referring to FIGS. 3 and 4, an automated straw handling and orienting device 30 is shown as including a hopper 32 having side walls 32A and a bottom plate 32B adapted to receive and support the disposable dispenser 10 with the end wall 18 of the dispenser 10 supported on the bottom plate 32B of the hopper 32.

The bottom plate 32B is shorter than the end wall 18 and in conjunction with a canted end wall 32A' of the hopper 32, provides a feeding area around the dispensing opening D of the dispenser 10 which is in registry with a rotary feed drum FD having longitudinal slots LS disposed therein to pick up the straws S, one to each slot LS, from the dispensing opening D and deliver the straws S, one at a time, into a dependent orienting tube 34 having, for example, an interval buffle or canted surface 36 therein to orient the straws longitudinally of the feed tube 34 (FIG. 4).

It can now readily be seen, for example, that if the feed drum FD is driven at a constant speed, adjustment of the size of the dispensing opening D in the dispenser 10 by adjustment of the slide member 24 will vary the rate at which the straws S will be available to the feed drum FD and hence, the ultimate rate of delivery of the straws S to the feed tube 34. At the least, the adjustability of the dispensing opening D provides an adjustment which makes the dispensing device 24 compatible to the machine speed of the related apparatus 30.

I claim:

1. Container means for dispensing a plurality of elongated objects in a common orientation and at a preselected rate of egress comprising:

a substantially rectangular cavity defined by first and second opposed side walls, first and second opposed end walls, a bottom wall and a foldable closure lid coextensive with the top edge of said first sidewall;

an interior flap coextensive with the top edge of said second end wall and foldable inwardly beneath said closure lid;

a slide member substantially coextensive with the top edges of said side walls and said end walls overlying said inwardly folded interior flap beneath said closure lid and extending outwardly of said second end wall in the provision of a retaining tab foldable downwardly into juxtaposition with the outer surface of said second end wall;

a score line on said closure lid coextensive with a portion of the top edge of said sidewall commencing at a point closely adjacent said second end wall in the provision of a closure flap foldable downwardly into juxtaposition with a portion of the outer surface of said second sidewall; and a removable section on said closure lid extending from the termination of said closure flap to said first end wall to define a maximum dispensing opening with the top edges of said first end wall and said first and second sidewalls;

said slide member being slidably retained beneath said closure lid and adjustably positionable to selectively vary the size of said dispensing opening between a fully closed condition and said maximum.

2. The container means of claim 1, wherein said cavity is filled with a plurality of elongated articles oriented parallel to said end wall; and wherein, when said container means is oriented to stand on said first end wall, said articles will egress through said dispensing opening in a common orientation and at a rate of egress selectively controlled by the position of said slide member relative to said opening.

* * * * *